United States Patent [19]

Ogasawara

[11] 3,987,263

[45] Oct. 19, 1976

[54] SWITCHING DEVICE FOR SWITCHING SIGNALS OF VERY HIGH AND ULTRAHIGH FREQUENCIES

[75] Inventor: Nobuo Ogasawara, Kyoto, Japan

[73] Assignee: Matsushita Electric Industrial Co., Ltd., Osaka, Japan

[22] Filed: Dec. 4, 1974

[21] Appl. No.: 529,546

[30] Foreign Application Priority Data

| | | |
|---|---|---|
| Feb. 19, 1974 | Japan | 49-20051 |
| Dec. 12, 1973 | Japan | 48-143336[U] |
| Dec. 24, 1973 | Japan | 48-1793[U] |
| Feb. 19, 1974 | Japan | 49-20419[U] |
| May 23, 1974 | Japan | 49-59614[U] |
| Dec. 12, 1973 | Japan | 48-143337[U] |

[52] U.S. Cl. ..... 200/153 S; 200/16 D; 200/305; 174/35 R

[51] Int. Cl.[2] ..... H01H 3/00

[58] Field of Search ..... 200/153 S, 304, 305, 200/16 R, 16 A, 16 B, 16 C, 16 D, 16 E, 16 F, 301; 339/143 R, 143 T; 174/35 R, 35 C; 335/301

[56] References Cited

UNITED STATES PATENTS

| | | | |
|---|---|---|---|
| 2,468,737 | 5/1949 | Davis | 339/143 T |
| 3,226,515 | 12/1965 | Concelman | 200/153 S |
| 3,485,966 | 12/1969 | Bailey et al. | 200/16 D |

*Primary Examiner*—Robert K. Schaefer
*Assistant Examiner*—Morris Ginsburg
*Attorney, Agent, or Firm*—Burgess Ryan and Wayne

[57] ABSTRACT

The invention discloses a switching device for switching signals of very high and ultrahigh frequencies comprising an insulating base, a plurality of stationary contacts, a sliding contact, and shielding means for isolating between the adjacent stationary contacts. The shielding means is electrically connected to a metal housing so that signal leakage due to the electrostatic and electromagnetic coupling may be prevented.

9 Claims, 17 Drawing Figures

FIG. 16
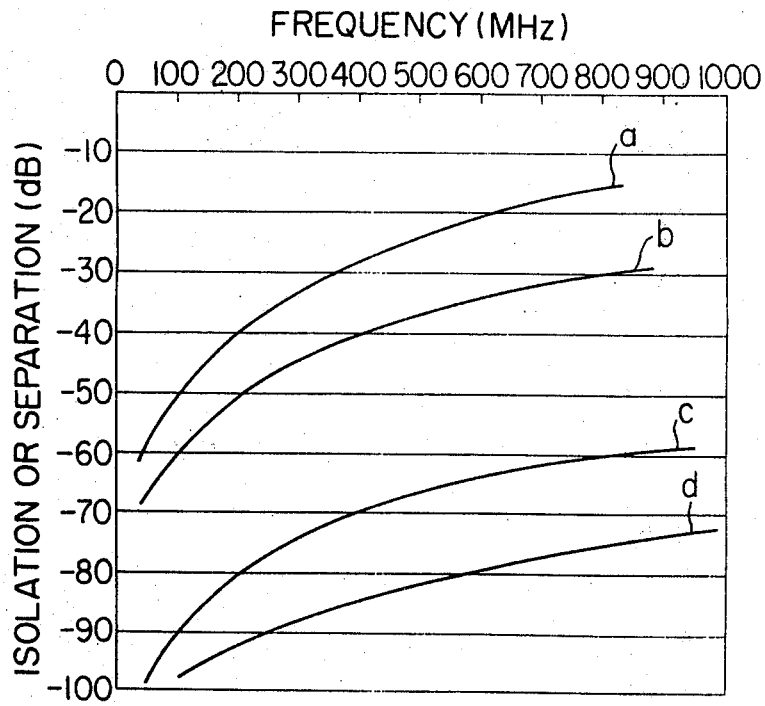
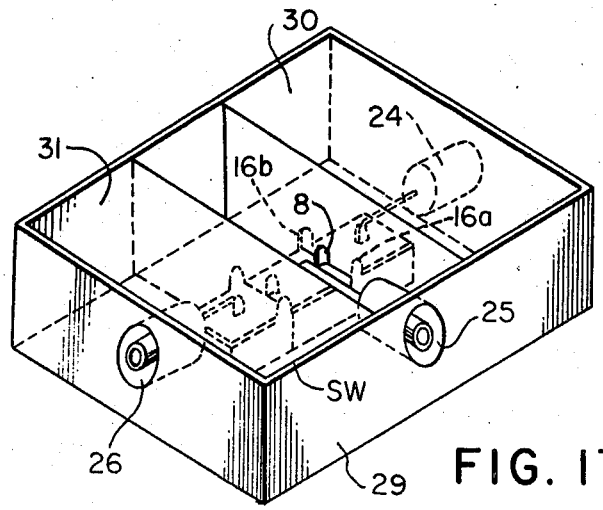
FIG. 17

SWITCHING DEVICE FOR SWITCHING SIGNALS OF VERY HIGH AND ULTRAHIGH FREQUENCIES

BACKGOUND OF THE INVENTION

The present invention relates to a signal switching device used in electrical equipment handling signals of very high and ultrahigh frequencies.

Signal switching devices of the type described are widely used in television receivers, video tape recorders, communication equipment, electronic instruments, and so on all of which handle the signals of very high and ultrahigh frequencies. In a signal switching device, there exist stray capacitance and inductance between the component parts thereof so that signal leakage due to electrostatic, and electromagnetic coupling occurs, resulting in poor signal isolation. In general, the higher the frequency of the signal, the poorer or lower the signal isolation becomes, and the leakage signal causes the harmful raidiation. Furthermore the reflection is caused by the poor impedance characteristic (voltage standing wave ratio) of the signal switching device so that the quality of transmission of the signals of very high and ultrahigh frequencies is much degraded. In order to overcome these defects, it has been proposed to use a switch with a plurality of circuits, to increase the dimensions of the switching device, and to employ the improved wiring designs. However, in prior art signal switching devices, signal isolation is reduced to the order of 6 to 10 dB per octave. In other words, the conventional signal switching devices cannot attain the signal isolation of the order of higher than 50 to 60 dB that is required in very high and ultrahigh frequency bands.

SUMMARY OF THE INVENTION

The first object of the present invention is therefore to provide a very high and ultrahigh frequency signal switching device which prevents the coupling between the contacts, improves the signal isolation 30 to 40 dB higher than the conventional switching devices, and considerably suppresses the unwanted radiation.

The second object of the present invention is to provide a very high and ultrahigh frequency signal switching device which may be provided by the simple modification of a conventional signal switching device.

The third object of the presenet invention is to provide a very high and ultrahigh frequency signal switching device which may be combined with coaxial-line connectors so as to reduce insertion loss.

The fourth object of the preset invention is to provide a very high and ultrahigh frequency signal switching device in which shielding plates and a cover is suitable shape and with suitable dimensions are used so that the impedance characteristic in the very high and ultrahigh frequency bands may be improved and that the better voltage standing wave ratio may be attained.

The fifth object of the present invention is to provide a very high and ultrahigh frequency signal switching device which is inexpensive to manufacture and is highly reliable and dependable in operation.

Briefly stated, the present invention provides a very high and ultrahigh frequency signal switching device comprising an insulating base, a plurality of stationary contacts attached to the insulating base, a movable contact for establishing the electrical connection between the desired pair of the stationary contacts, and shielding means interposed between the adjacent stationary contacts. The shielding means is directly electrically connected to a metal housing in order to ensure the electrical isolation between the adjacent stationary contacts.

BRIEF DESCRIPTION OF THE DRAWING

FIG. 8 is a perspective view illustrating only the major parts of a fourth embodiment of the present invention;

FIG. 16 is a graph of frequency-separation or isolation characteristic curves of a prior art signal switching device and of the fourth and sixth embodiments of the present invention; and FIG. 17 is a perspective view according to FIG. 12 with the shielding plates of FIG. 13 mounted therein.

DESCRIPTION OF THE PREFERRED EMBODIMENTS

PRIOR ART, FIG. 1

Figure 1:
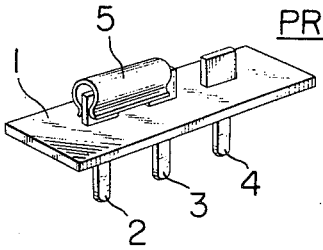
FIG. 1 PRIOR ART
FIG. 1 is a perspective view illustrating only the major parts of a prior art signal switching device.

Prior to the description of the preferred embodiments of the present invention, the prior art signal switching device will be described briefly with reference ot FIG. 1 in order to point out some specifically the defects thereof. The signal switching device shown in FIG. 1 is a single pole double throw slide switch comprising an insulating base 1, three fixed or stationary contacts 2, 3, and 4, and a sliding contact 5. The sliding contact 5 is shown as bridging between the contacts 2 and 3 while breaking the path between the contacts 3 and 4. That is, the high frequency wave signal applied to the stationary contact 2 passes through the slider 5 to the stationary contact 3. There exists a stray capacitance between the opened contacts 3 and 4 due to the air gap and the base 1 with a dielectric constant. There also exists a stray inductance between the contacts 3 and 4. In addition, there also exist various stray capacitance and inductance between the base 1, stationary contacts 2, 3 and 4 and the slider 5.

These various stray capacitance and inductance produce electrostatic and electromagnetic couplings between the stationary contacts 3 and 4 which cause signal leakage. The higher the frequency of the signal, the higher the degree of the signal leakage becomes. When the stationary contact 4 is connected to, for instance, an antenna circuit, the high frequency signal leaked to the stationary contact 4 is radiated from the antenna. In case of the UHF signal, its level drops to 20 to 30 dB because of the signal leakage from the stationary contact 3 to the contact 4.

THE INVENTION, FIRST EMBODIMENT, FIGS. 2 THROUGH 4

Figure 2:
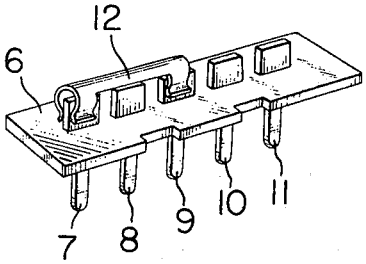
FIG. 2 is a perspective view illustrating the major parts of a first embodiment of the present invention.

Next referring to FIGS. 2 through 4, the first embodiment of the present invention will be described, As shown in FIG. 2, the signal switching device in acordance with the present invention comprises an insulating base 6, five stationary contacts 7, 8, 9, 10, 11 and a sliding contact 12. The sliding contact 12 is so designed as to bridge between the stationary contact 9 and the stationary contact 7 or ll. The contacts 8 and 10 which are interposed between the stationary contacts 7 and 9 and between the stationary contacts 9 and 11 serve as shielding means which are gounded. That is, the grounding terminals 8 and 10 serve not only to shield the signals leakage between the stationary contacts 7, 9 and 11 but also to reduce the stray capacitance and inductance between them when the grounding terminals 8 and 10 are electrically connected to a metal frame, housing or chassis as will be described in detail hereinafter.

Figure 3:
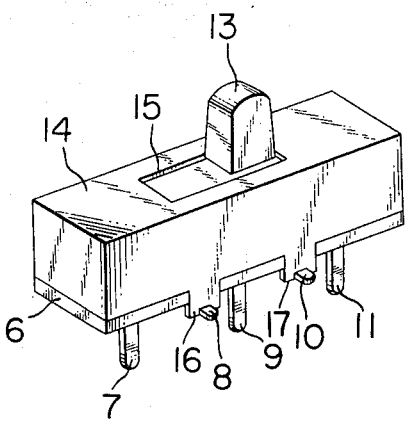
FIG. 3 is a perspective view illustrating the outer appearance of the first embodiment.
Figure 4:
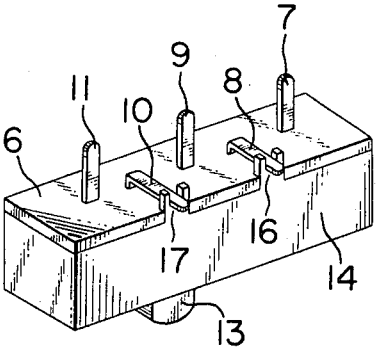
FIG. 4 is a perspective view thereof turned upside down.

Referring to FIGS. 3 and 4, the grounding terminals 8 and 10 are bent at a right angle and fitted into bifurcated ends of lugs 16 and 17 extended from a metal casing 14 as best shown in FIG. 4 so that electrical connection may be established between the grounding terminals 8 and 10 and the metal casing 14. Since the stationary contacts 7, 9 and 11 are isolated from each other in the manner described above, the high frequency signal leakage may be improved by higher than 10 dB compared with the prior art signal switching means. The sliding contact 12 is atttached to a slider 13 with a projection which extends through an opening 15 formed through the top of the metal casing 14. As with a conventional slide switch, the sliding contact 12 may be positioned by moving the slider 13 back and forth.

SECOND EMBODIMENT, FIG. 5

Figure 5:
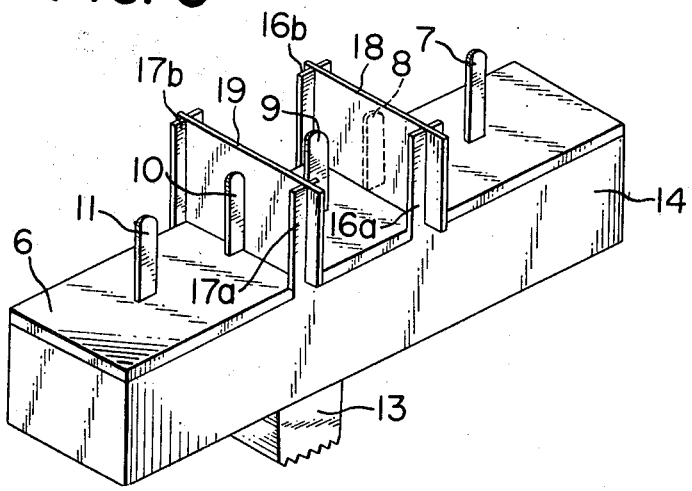
FIG. 5 is a perspective view illustrating only the essential parts of a second embodiment of the present invention.

The second embodiment of the present invention shown in FIG. 5 is substantially similar in construction to the first embodiment except the arrangement for attaining the more improved isolation between the stationary contacts 7, 9, and 11. That is, the grounding terminals 8 and 10 electrically contact shielding plates 18 and 19, respectively, made of a metal, and are fitted into the grooves or slits of projections 16*a*, 16*b*, 17*a*, and 17*b* formed integral with the metal casing 14. The shielding plates 18 and 19 are higher than the grounding terminals 8 and 10. The grounding terminals 8 and 10 may be connected to the shielding plates 18 and 19, and soldered if so desired. The high frequency signal leakage may be reduced by 20 to 30 dB compared with the prior art signal switching device.

THIRD EMBODIMENT, FIGS. 6 AND 7

Figure 6:
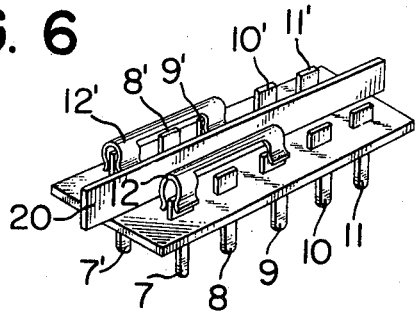
Figure 7:
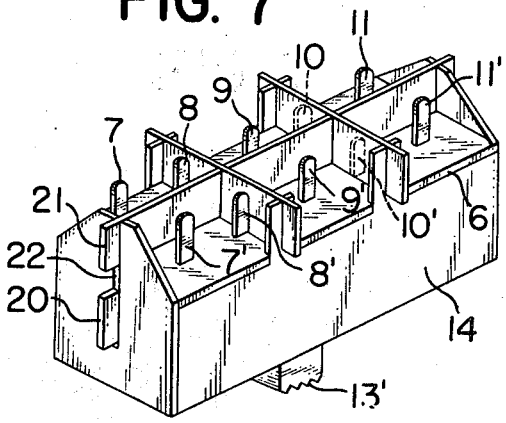
FIG. 7 is a perspective view thereof turned upside down.

The third embodiment shown in FIGS. 6 and 7 comprises two signal switching devices of the type of the second embodiment which are ganged together. The base 6 is further provided with stationary contacts 7′, 9′, and 11′, grounding terminals 8′ and 10′, a sliding contact 12′ which is attached to a slider 13′, all of which correspond to the stationary contact 7, 9, and 11, the grounding terminals 8 and 10, and the sliding contact 12 attached to the slider 13, respectively, of the second embodiment. The corresponding stationary contacts 7, 7′, 8, 8′, 9 and 9′, are isolated from each other by shielding plates 20 and 21 which are fitted into center grooves 22 formed through the opposed side walls of the metal casing 14. The longitudinal shielding plates 20 and 21 are also made into electrical contact with the transverse shielding plates 18 and 19 as best shown in FIG. 7.

FOURTH EMBODIMENT, FIGS. 8 AND 9

Figure 8:
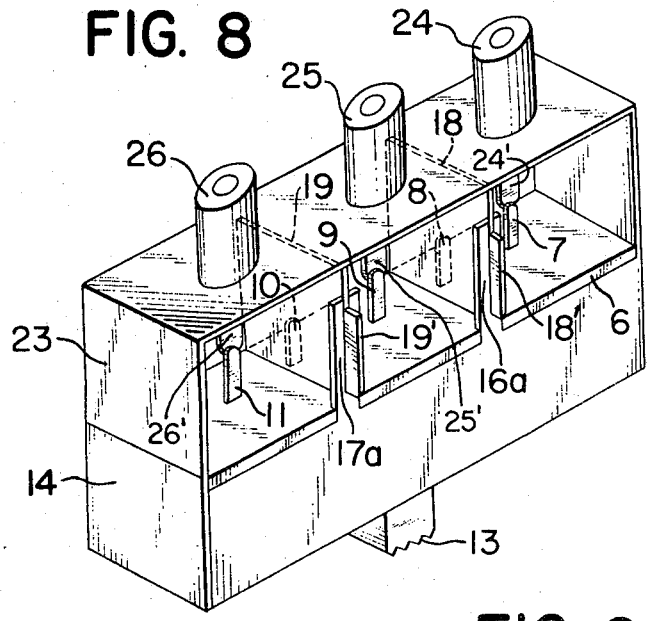
FIG. 8 is a perspective view illustrating only the essential parts of a third embodiment of the present invention having two arrays of the stationary contacts.
Figure 9:
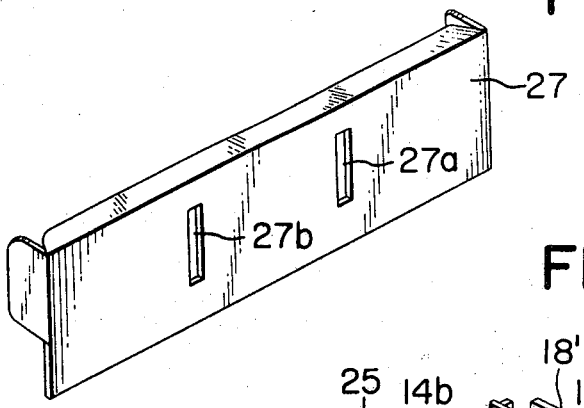
FIG. 9 is a perspective view of a side plate thereof.

In the fourth embodiment of the present invention shown in FIG. 8, the second embodiment shown in FIG. 5 is combined with coaxial-line connectors in order to improve the impedance characteristic. Three coaxial-line connectors 24, 25, and 26 are attached to a metal cover 23 which in turn is attached to the metal casing 14 in such a way that the cover 23 electrically contacts the casing 14 and the shielding plates 18 and 19 in electrical contact with the grounding terminals 8 and 10 and that the core conductors 24′, 25′, and 26′ of the coaxial-line connectors 24, 25, and 26 electrically contact the stationary terminals 7, 9, and 11, respectively. The characteristic impedance between the stationary contacts 7, 9, and 11 and the core conductors 24′, 25′, and 26′ is dependent upon the volume of the spaces defined by the cover 23 and the shielding plates 18 and 19. Therefore, the shielding plates 18 and 19 must be positioned so as to match the characteristic impedance. In the fourth embodiment, the shielding plates 18 and 19 are provided with projections 18′ and 19′, and a side plate 27 made of a metal has its slots 27*a* and 27*b* fitted over these projections 18′ and 19′, respectively, so that the side plate 27 may be attached to the cover 23 and may be made into electrical contact therewith. The cover 23 and the side plates 27 serve to prevent leakage to the exterior from the terminals 7, 9, and 11 and the base 6.

FIFTH EMBODIMENT, FIGS. 10 AND 11

Figure 10:
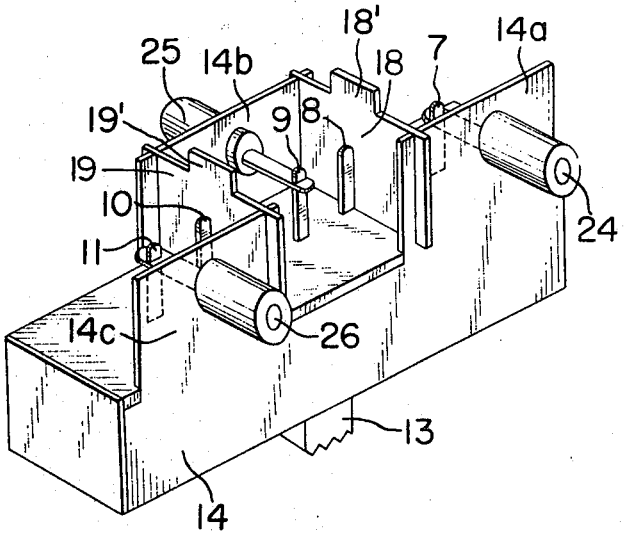
FIG. 10 is a perspective view illustrating only the essential parts of a fifth embodiment of the present invention.
Figure 11:
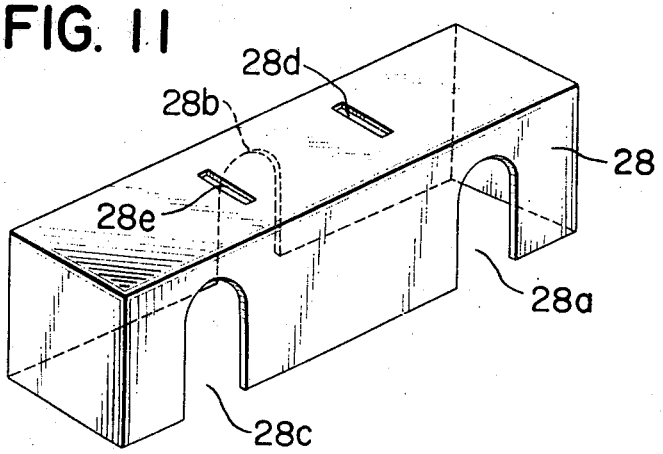
FIG. 11 is a perspective view of a metal cover thereof.
Figure 12:
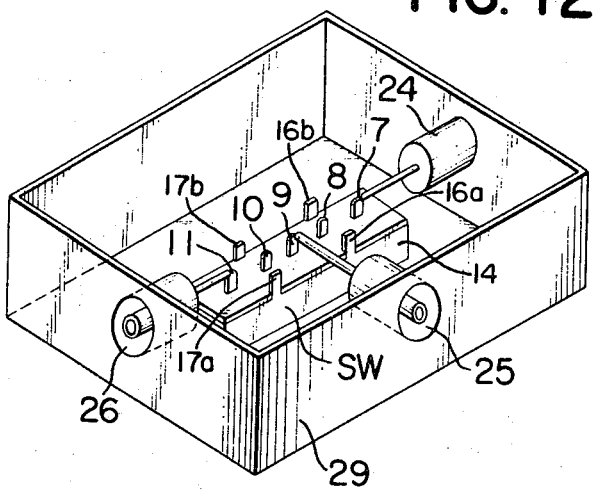
FIG. 12. is a perspective view of a sixth embodiment of the present invention using a box-shaped metal housing.

The fifth embodiment shown in FIG. 10 is a modification of the fourth embodiment shown in FIG. 8. In the fifth embodiment, the coaxial-line connectors 24, 25, and 26 are attached to the extended side wall portions 14*a*, 14*b*, and 14*c*, respectively, of the casing 14 so as to be at right angles with respect to the stationay contacts 7, 8, and 9, respectively. The shielding plates 18 and 19 are fitted into the grooves formed through the extended wall portions 14*a*, 14*b*, and 14*c* so that the electrical connection between them may be attained. A cover 28 made of a metal (See FIG. 11) is attached to the assembly shown in FIG. 10. The cover 28 is provided with three openings 28*a*, 28*b*, and 28*c* through which the coaxial-line connectors 24, 25, and 26 extendeoutwardly, respectively, and two slots 28*d* and 28*e* which are fitted over the upright projections 18′ and 19′, respectively, of the shielding plates 18 and 19. Thus the electrical connection between the cover 28 and the casing 14 may be attained, and the signal leakage may be prevented.

SIXTH EMBODIMENT, FIGS. 12, 13, 14, 15 AND 17

In the sixth embodiment, within a metal box 29 is disposed a high frequency signal switching device SW which is substantially similar in construction to the second embodiment (See FIG. 5) except that it is not provided with the shielding plates 18 and 19. The coaxial-line connectors 24, 25, and 26 are attached to the side walls of the metal box 29 in such a way that their outer conductors electrically contact the metal box 29 and that their core conductors are connected to the stationary contacts 7, 9, and 11, respectively.

Figure 13:
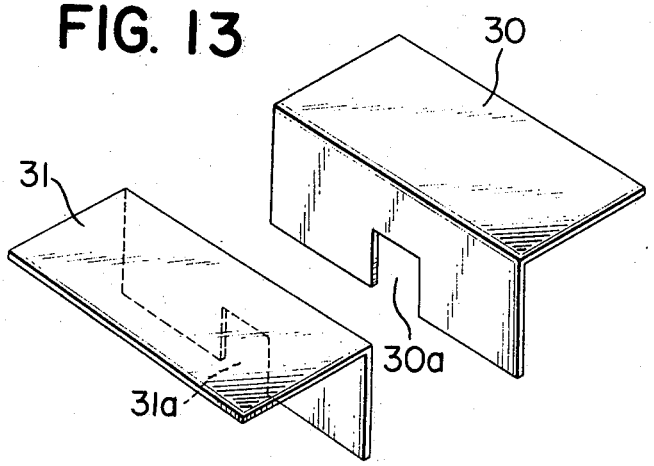
FIGS. 13 and 14 are perspective views of shielding plates used in the sixth embodiment.

In order to isolate the stationary contacts 7, 9, and 11 from each other, shielding plates 30 and 31 shown in FIG. 13 are used. The shielding plate 30 is fitted into the metal box 29 in such a way that its opening 30*a* is fitted over the signal switching device SW and it engages the grounding terminal 8 and the projections 16*a* and 16*b* of the metal casing 14. In like manner, the shielding plate 31 is fitted into the metal box 29 in such a way that its opening 31*a* is fitted over the switching device SW and that it engages with the grounding terminal 10 and the projections 17*a* and 17*b* of the metal casing 14.

In order to provide better isolation between the stationary contacts 7, 9, and 11, it is required that the shielding plate has two planes or more.

Figure 14:
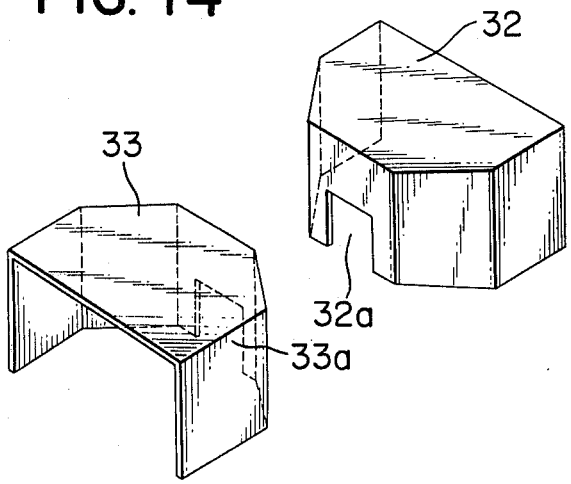

For this purpose, shielding plates 32 and 33 of the type shown in FIG. 14 may be used instead of the shielding plates 30 and 31 shown in FIG. 13. These shielding plates 32 and 33 have openings 32*a* and 33*a*, respectively, and are fitted into the metal box 29 in a manner substantially similar to that described above with reference to the shielding plates 30 and 31.

Figure 15:
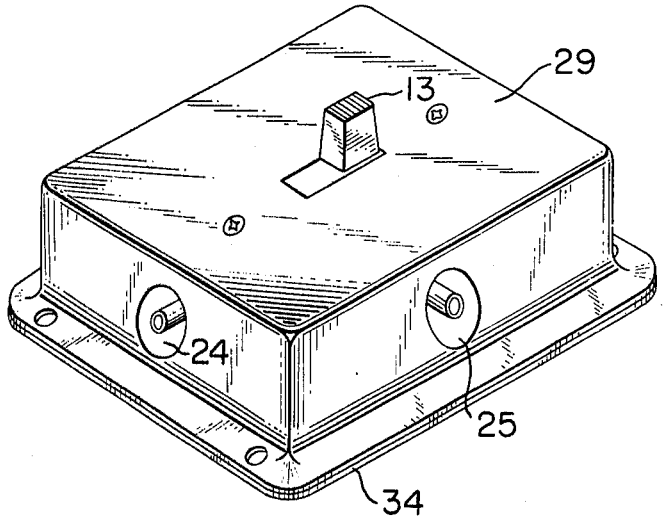
FIG. 15 is a perspective view of the assembled sixth embodiment.

The shielding plates 30 and 31 or 32 and 33 are fitted into the metal box 29 so as to attain the electrical connection therewith and to define the electrical spaces therein matching the characteristic impedance between the stationary contacts 7, 9, and 11 and the coaxial-line connectors 24, 25, and 26, respectively. Thereafter, a metal bottom 34 is attached to the metal box 29 so that the switching device with the coaxial-line connectors is completed as shown in FIG. 15. The slider 13 is extended from the top of the metal box 29.

FIG. 16 is a graph illustrating the relationship between the frequency and separation or isolation. The curve (*a*) is the characteristic curve of othe prior art signal switching device. It is seen that the effective operating range is less than 100 MHz in the high frequency band. The curve (*b*) is the characteristic curve of a prior art signal switching device which was modified to some extent according to the present invention. It is seen that this switching device cannot be used in the very high frequency band. The curve (*c*) is the characteristic curve of the fourth embodiment (See FIG. 8). It is seen that this signal switching device may attain the sufficient separation or isolation at each band in the ultrahigh frequency range. The curve (*d*) is the characteristic curve of the sixth embodiment (See FIGS. 12 through 15) of the present invention.

The satisfactory effects may be attained by any of the embodiments of the present invention described hereinbefore, but if it is required to attain the higher isolation than that attained by one of the preferred embodiments, the suitable combination of the preferred embodiments may be used.

What is claimed is:

1. A signal switching device for switching signals in the very high and ultrahigh frequency bands comprising a. an insulating base;

b. a plurality of first stationary contacts attached to one side of said insulating base and each having a leg projecting from the other side of said insulating base;

c. second stationary contacts attached to said one side of said insulating base between said first stationary contacts and each having a leg projecting from said other side of said insulating base;

d. a sliding contact having a slider mounted to form an electric circuit between two desired first statonary contacts without being connected to said second stationary contacts between said two desired contacts, said sliding contact being slidable to contact other pairs of first said stationary contacts and to contact said second statonary contacts intermediate said first stationary contacts;

e. a metal casing covering said stationary contacts and said sliding contact on said one side of said insulating base, said metal casing having legs electrically connected to said second stationary contacts; and f. conductive metal shielding plates mounted to extend from the other side of said insulating base a distance at least equal to the height of said legs of said stationary contacts, said shielding plates being at least wider than said metal casing, said conductive metal shielding plates being electrically connected to said second stationary contacts and to said metal casing, whereby electrostatic and electromagnetic coupling between said first stationary contacts is reduced.

2. A signal switching device as set forth in claim 1 wherein each of said shielding plates interposed between the first stationary contacts is electrically coupled to said second stationary contacts between the respective first stationary contacts.

3. A signal switching device as set forth in claim 1 wherein a plurality of groups each consisting of said first stationary contacts and said second stationary contacts are separated from each other by first of said conductive metal shielding plates.

4. A signal switching device as set forth in claim 3 wherein said first stationary contacts in each group are further isolated from each other by second of said conductive metal shielding plates elecrically connected to said first of said conductive metal shielding plates, to said metal casing and to said first stationary contacts.

5. A signal switching device as set forth in claim 1 comprising a metal cover attached to said insultating base and covering said legs of said stationary contacts;

a plurality of coaxial-line connectors having central conductors electrically connected to said first stationary contacts and outer conductors attached to the extended portions of one of said metal casing and said metal cover;

said metal casing and said metal cover being electrically connected to each other.

6. A signal switching device for switching the signals in the very high and ultrahigh frequency bands comprising:

a. a switch comprising a metal casing enclosing an insulating base, a plurality of first stationary contacts attached to said insulating base, second stationary contacts attached to said insulating base between said first stationary contacts, and a sliding bridge contact having a slider and mounted to form an electric circuit with two desired contacts of said first stationary contacts without contacting a second stationary contact therebetween;

b. a metal box within which said switch is mounted;

c. coaxial-line connectors mounted with central conductors electrically connected to said first stationary contacts and outer conductors attached to said metal box; and d. metal conductive shielding plates isolating each of said first stationary contacts and electrically connected to said second stationary contacts, said metal casing and said metal box.

7. A signal switching device as set forth in claim 6 wherein said metal conductive shielding plates have at least two side faces.

8. A high frequency signal switch comprising an insulating plate, a plurality of stationary contacts mounted in a line on said plate and having contact ends extending from one side of said plate and leg ends extending from the other side of said plate, a slider mounted to selectively contact said contact ends and being shaped to interconnect alternate pairs of contact ends, a conducting case enclosing said slider and said contact ends on said one side of said plate, and a plurality of conducting plates extending from the other side of said insulating plate normal to said insulating plate and to said line of contacts, said conducting plates having a height at least equal to the height of said leg ends, said conducting plates extending in line with alternate stationary contacts and being connected thereto, said conducting case extending to electrically contact said conducting plates.

9. The high frequency signal switch of claim 8 further comprising a conductive box, said conducting case, insulating plate and conductive plates being mounted within said box, said conductive plates extending to the inner walls of said box to separate said box into compartments, and being electrically connected to said box, and a plurality of coaxial cables each having a central conductor extending through and insulated from said box into a separate compartment and being connected to a separate leg of a stationary contact therein to which a conductive plate is not connected, the outer conductors of said coaxial cables being connected electrically to said box.

* * * * *

UNITED STATES PATENT OFFICE

CERTIFICATE OF CORRECTION

Patent No. 3,987,263 Dated October 19, 1976

Inventor(s) Nobuo Ogasawara

It is certified that error appears in the above-identified patent and that said Letters Patent are hereby corrected as shown below:

Column 1, line 5: "BACKGOUND" should be --BACKGROUND--.

line 20: "raidiation" should be --radiation--.

line 47: "presenet" should be --present--.

line 51: "preset" should be --present--.

line 53: "is" should be --in--.

Column 2, line 53: "ot" should be --to--; "some" should be --more--.

Column 3, line 17: "acordance" should be --accordance--.

line 25: "gounded" should be --grounded--.

Column 4, line 54: "stationay" should be --stationary--.

Column 5, line 48: "othe" should be --the--.

Column 6, line 14-15: "statonary" should be --stationary--.

line 19: "statonary" should be --stationary--.

line 53: "insultating" should be --insulating--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*